United States Patent [19]

Oberdorf

[11] Patent Number: 5,065,564

[45] Date of Patent: Nov. 19, 1991

[54] APPARATUS FOR THE FORMATION OF CIGARETTE GROUPS

[75] Inventor: Manfred Oberdorf, Gevelsberg, Fed. Rep. of Germany

[73] Assignee: Maschinenfabrik Alfred Schmermund GmbH & Co., Gevelsberg, Fed. Rep. of Germany

[21] Appl. No.: 603,880

[22] Filed: Oct. 25, 1990

[30] Foreign Application Priority Data

Oct. 28, 1989 [DE] Fed. Rep. of Germany ..... 3935971

[51] Int. Cl.[5] ..... B65B 19/10

[52] U.S. Cl. ..... 53/150; 53/151; 53/234; 53/529

[58] Field of Search ..... 53/148, 149, 150, 151, 53/234, 529

[56] References Cited

U.S. PATENT DOCUMENTS 3,058,278 10/1962 Horgan ..... 53/529

4,179,864 12/1979 Focke ..... 53/234 X 4,571,918 2/1986 Zeitel ..... 53/149

4,617,783 10/1986 Manservisi ..... 53/529

4,962,634 10/1990 Boldrini ..... 53/234

*Primary Examiner*—John Sipos

*Attorney, Agent, or Firm*—Chilton, Alix & Van Kirk

[57] ABSTRACT

An apparatus for forming cigarettes groups consisting of a plurality of cigarette layers to be received by a pack, employs a group-forming turret and cells equipped with a tamping device adjustable relative to the cell floor via a control cam. Layers of cigarettes are transferred to the cells from exit orifices of a funnel. To prevent a change of position of the cigarettes in the cells as a result of the forces occurring during the movement of the turret, the control cam for the tamping devices possesses, for each exit orifice, a step opening the respective cell at least by the amount of the height of a cigarette layer, and movable cam portions serving to temperarily bridge the steps.

20 Claims, 3 Drawing Sheets

APPARATUS FOR THE FORMATION OF CIGARETTE GROUPS

BACKGROUND OF THE INVENTION (1) Field of the Invention

This invention relates generally to an apparatus for the formation of cigarette groups consisting of a plurality of cigarette layers to be received by a pack. More specifically, the invention relates to an apparatus wherein a cigarette layer is axially transferred from one of a plurality of parallel exit orifices of a cigarette funnel into a cell equipped with a tamping device adjustable relative to the cell floor via a control cam, and the cells are arranged for rotation coaxially with a group-forming turret and, in the transfer region from the cigarette funnel to the group-forming turret, the cells are in engagement with a control cam which aligns the cells with the exit orifices.

(2) Description of Prior Art

An apparatus of a type to which the invention relates is disclosed in German Patent document DE-A-3,331,745. In the latter German reference the cells of the group-forming turret are arranged in a stationary manner, so that exit orifices of the cigarette funnel have to be arranged correspondingly in alignment with the turret axis. This presents problems with regards to the production of a complete bottom-most layer of cigarettes which is to be pushed out in each case, since the particular layer to be pushed out does not lie horizontally, but obliquely. Furthermore, the tamping devices are retracted from the cigarettes before the group-forming turret reaches the standstill position for receiving the next row, and therefore errors can occur.

An apparatus of the general type described in the introduction is disclosed in French Patent document FR-A-944,485. In the latter French reference, tamping devices are continuously pivotable relative to the cell floor via cam portions. Therefore, apart from the fact that the devices subject the cigarettes of the first rows to stress at particular points in an undesirable way, the devices also release the cigarettes while the group-forming turret is still rotating.

SUMMARY OF THE INVENTION

An object of the invention is to provide an apparatus of the general type described in the introduction in which errors caused by oblique or misplaced lower cigarette layers are prevented.

This object is achieved by a control cam for the tamping devices wherein, for each exit orifice, a step is provided for opening the respective cell by at least the amount of the height of a cigarette layer, and movable cam portions for temporarily bridging the steps during turret rotation are provided.

At the same time, the tamping devices hold down the already transferred cigarette rows until the group-forming turret comes to a standstill for the purpose of receiving the next cigarette row. The tamping devices then lift off from the already transferred cigarettes only when the group-forming turret is at a standstill for pushing in the next row, so that these cigarettes cannot change their position in the cell. The movable cam portions serving for temporarily bridging the steps act correspondingly on the tamping devices during the turret rotation and release the devices when the turret is at a standstill. The cells of the group-forming turret are arranged pivotally and are cam-controlled in such a way that they can be brought into alignment with horizontally arranged exit orifices of the cigarette funnel.

The invention is explained in more detail below by means of the exemplary embodiment illustrated in the accompanying figures.

DETAILED DESCRIPTION OF THE PREFERRED EMBODIMENT

Figure 1:
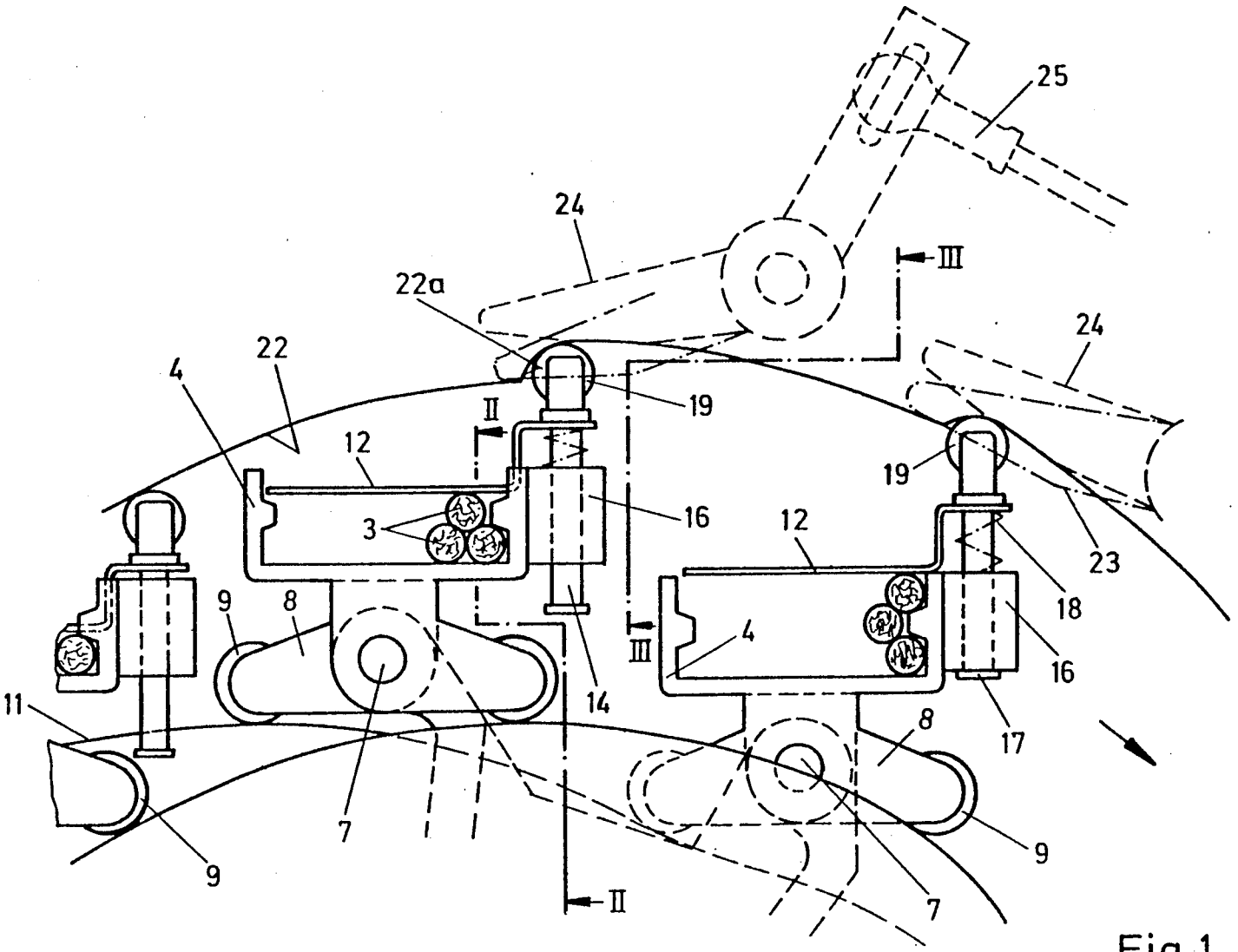
FIG. 1 shows diagrammatically and in cut-out form a front view of an apparatus for the formation of cigarette groups.
Figure 3:
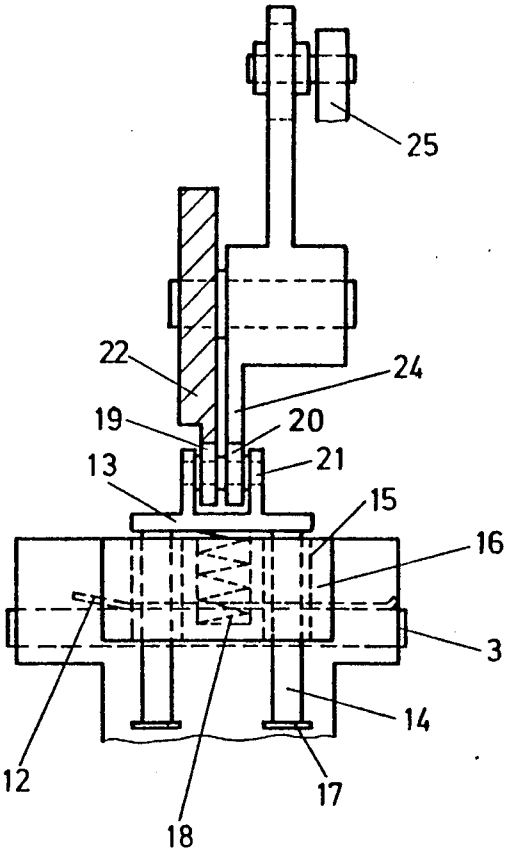
FIG. 3 shows a view along the line III—III of FIG. 1.

The apparatus for the formation of cigarette groups comprises a cigarette funnel 1 with cigarette shafts terminating at corresponding exit orifices 2. The number of exit orifices 2 corresponds to the number of cigarette layers provided for each cigarette pack. The rectangular exit orifices 2 are arranged horizontally and parallel to one another in a longitudinal direction, but are offset vertically and spaced apart. The particular bottom-most layer of cigarettes 3, which is arranged adjacent to the respective exit orifice 2, is pushed by means of a slide into a cell 4 arranged adjacent to the respective exit orifice 2. A plurality of substantially identical cells 4 are located on the circumference of a group-forming turret 5. The group-forming turret 5 is incrementally rotatable by one cell division at a time by means of a stepping drive.

The cells 4 extend axially relative to the turret 5 which can itself be incrementally displaced in steps of one cell division units via a shaft 6. The cells 4 are articulated on the turret 5 on the circumference of the latter with an equal axial spacing so as to be pivotable about axles 7. Axles 7 are equidistantly spaced about the shaft 6. The cells 4 are each equipped on the underside with a rocker comprising two axially spaced arms 8 which are rotatably arranged about the axles 7. One of the arms 8 is extended in the direction of rotation of the turret 5 and the other arm is extended oppositely to the direction of rotation of the turret 5. The free ends of the two arms 8 each carry a roller 9. Each of the rollers 9 is in engagement with stationary cam disks 10 and 11. The two cam disks 10 and 11 are designed in such a way that the cells 4, when located in the transfer position for the cigarettes 3 opposite the respective exit orifices 2 of the cigarette funnel 1, are aligned with the exit orifices 2.

Figure 2:
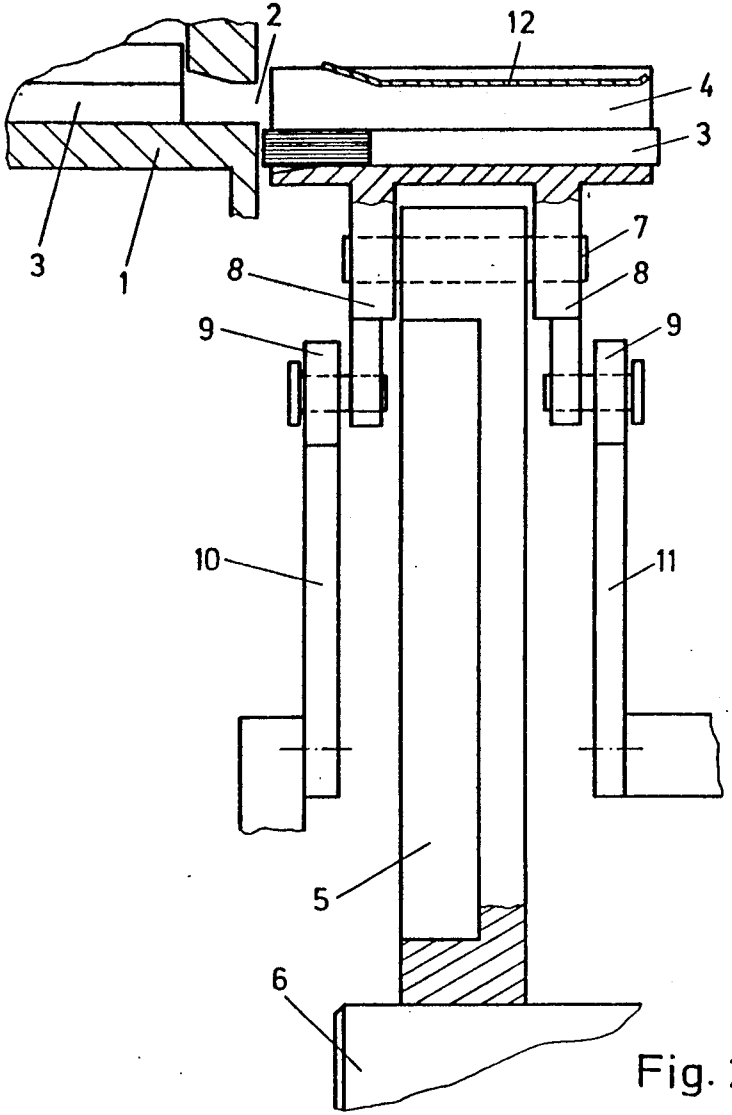
FIG. 2 show, in cut-out form, a view along the line II—II of the apparatus of FIG. 1.

Each cell 4 is equipped with a tamping device 12 comprising a member having a planar tamping surface and a slightly inclined input edge to facilitate reception of the cigarette layer by the cell as shown in FIGS. 1 and 2. As shown in FIG. 1, the tamping member extends essentially over the cell width. The mount 13 of the tamping device 12 carries two guide journals 14 which are guided in guide sleeves 15 of a guide block 16 attached laterally to the cell 4. The guide journals 14 carry a stop 17 at the free end. The stops 17 function so that the tamping devices 12 can move away only at most to a predetermined spacing from the bottom or floor of the cell 4 which spacing is sufficient to accommodate the maximum number of cigarettes rows in the cell 4. The tamping device 12 is prestressed into the last-described position via a spring 18 engaging on the device 12 and on the guide block 16. The tamping device 12 is always parallel to the floor of the cell 4.

Furthermore, the mount 13 for the tamping device 12 carries two rollers 19 and 20 which are mounted on the same axle 21. Axle 21 is parallel to the turret axis. The roller 19 is in engagement with a stationary control cam 22 which serves to bring the tamping device 12 into the position suitable for pushing in a cigarette row and to maintain this position as far as the next exit orifice 2 of the cigarette funnel 1. Accordingly, the control cam 22 possesses recessed steps 22*a* which ensure that the tamping device 12 can for each loading of the cell move away by an amount corresponding to the height of the cigarette layer from the radially inner cell floor radially outwards towards the turret circumference, and be maintained essentially in this position as far as the next step 22*a*.

In contrast to the described interaction of roller 19, roller 20 interacts with movable cam portions 23. The cam portions 23 are formed on levers 24 and are located in the region of the steps 22*a*. One lever 24 is mounted rotatably, for example, on the stationary control cam 22 and functions as an angle lever. A cam-controlled crank 25 engages on the lever end facing away from the roller 20, in order to pivot the lever between the position of FIG. 1 represented by dashed lines and that represented by dot/dashed lines. During the transport of cigarettes 3 located in a given cell 4, the lever 24 is in the position represented by dot/dashed lines, so that the corresponding step 22*a* is bridged by the cam portion 23. When the cell 4 reaches the new transfer position for a cigarette layer adjacent to an exit orifice 2, the lever 24 is raised into the position represented by dashed lines, so that the tamping device 12 lifts off from the previously introduced cigarette layer. The displaced tamping device 12 opens the way for inserting the next cigarette layer, since the roller 19 now comes into engagement with the next step 22*a* of the control cam 22 and the roller 20 no longer exerts a pressing-down effect on the tamping device.

If appropriate, to make it easier to insert a cigarette layer, in the region of the step 22*a* the tamping device 12 can also be raised somewhat more than necessary, so as then to press it onto the cigarettes 3 again via the control cam 22 during the further rotation of the cell 4. In this case, the control cam 22 must extend as far as the pushing-out position of the formed cigarette block for the particular cell 4. In this case, the stops 17 must be omitted or must allow a corresponding larger stroke of the tamping device 12.

Figure 4:
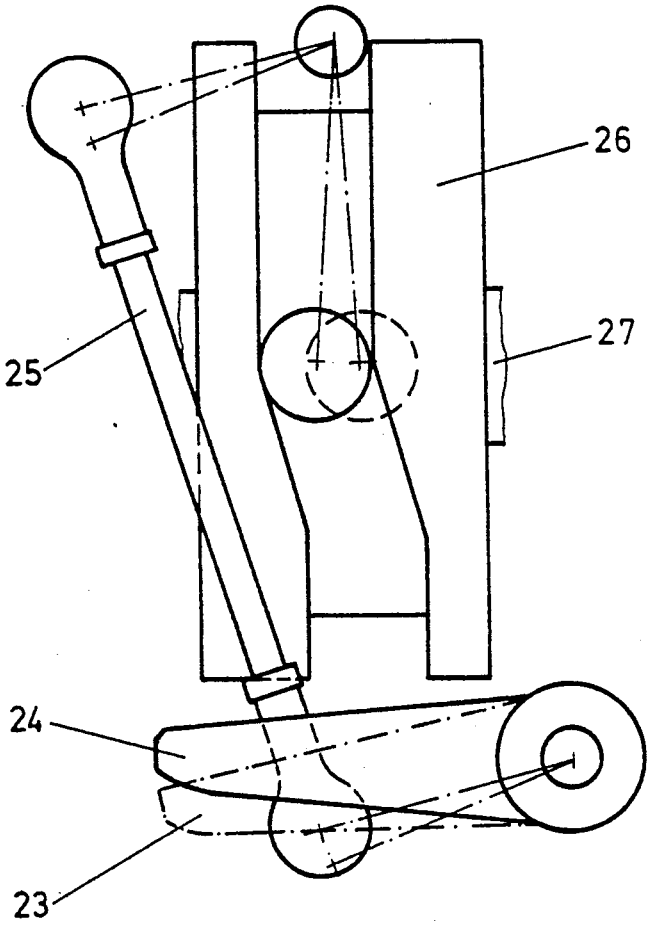
FIG. 4 shows a further embodiment with regard to the control of the tamping devices of FIG. 1.

In the embodiment illustrated in FIG. 4, the levers 24 are controlled by axially grooved cams 26 which are located on a common shaft 27.

A lever 24 assigned a corresponding step 22*a* of the control cam 22 can also be provided for pushing in the bottom-most cigarette layer.

Instead of pushing the particular first, second, etc. cigarette layer over into a respective cell 4, the arrangement can also be such that the particular first, second, etc. cigarette layer is respectively pushed simultaneously into two or more cells 4. For this, the group-forming turret 5 is then incrementally rotated further by two or more cell divisions at a time.

While the foregoing description has been set forth for purposes of illustrating a preferred embodiment of the invention, the foregoing description should not be deemed a limitation of the invention. Accordingly, various modifications, adaptations and alternatives may occur to one skilled in the art without departing from the spirit and scope of the present invention.

What is claimed is:

1. Apparatus for forming cigarette groups comprising a plurality of layers of cigarettes for a pack, said apparatus comprising:

turret means for forming cigarette groups comprising a turret rotatable about a first axis;

cell means comprising a plurality of cells each having a floor for receiving cigarette groups, said cells being pivotally mounted to said turret means for rotation coaxially of said first axis;

funnel means comprising means defining a plurality of parallel exit orifices;

first control cam means engageable with the cell means for aligning the cells with the exit orifices at load positions;

transfer means for axially transferring a cigarette layer from an exit orifice to a cell;

tamping means for tamping a cigarette layer in each cell; and second control cam means for adjusting the position of the tamping means relative to an associated cell floor comprising stationary cam means comprising a step for allowing displacement of said tamping means at least by the amount of the height of a cigarette layer at load positions and movable cam means for temporarily positioning the tamping means against a cigarette layer during rotation of said cell and releasing said tamping means at the load positions.

2. Apparatus according to claim 1, wherein the tamping means comprises a planar tamping surface which is displaceable parallel to the associated cell floor.

3. Apparatus according to claim 1 wherein the tamping means further comprises two coaxial rollers of which one can be brought into engagement with the stationary cam means and the other with the movable cam means.

4. Apparatus according to claim 1 further comprising cam-controlled crank means for controlling the movement of the movable cam means.

5. Apparatus according to claim 1 further comprising at least one guide journal disposed laterally relative to the cell and said tamping means is mounted to at least one guide journal.

6. Apparatus according to claim 1 further comprising a rocker having two arms and wherein each cell is articulated rotatably on the group-forming turret means via said rocker, the first control cam means further comprising two cam disks of which one is in engagement with one rocker arm and the other with the other rocker arm.

7. Apparatus according to claim 1 further comprising a spring which biases the tamping means into a position closing off a particular cell.

8. Apparatus according to claim 5 wherein the guide journal further has a stop for limiting the maximum displacement of the tamping means.

9. Apparatus according to claim 1 wherein said second control cam means further comprises a control cam for the tamping means, said control cam being configured so that the tamping means, during the transfer of a cigarette layer to a cell, are displaced outward from the cell floor by distance somewhat more than the height of a cigarette layer and, during the further rotatable movement of the cell, the tamping means are pressed onto the cigarette layer last loaded in the cell.

10. Apparatus according to claim 1 wherein the tamping means are positionable outwards in relation to the radially inner cell floors.

11. Apparatus for forming cigarette groups comprising a plurality of layers of cigarettes for a pack, said apparatus comprising:

turret means for forming cigarette groups comprising a turret rotatable about a first axis;

cell means comprising a plurality of cells each having a floor for receiving cigarette groups, said cells being pivotally mounted to said turret means for rotation coaxially of said first axis;

funnel means comprising means defining a plurality of parallel exit orifices;

first control cam means engageable with the cell means for aligning the cells with the exit orifices at load positions;

tamping means for tamping a cigarette layer in each cell, said tamping means comprising a member having a planar tamping surface which is displaceable in parallel relationship to the associated cell floor; and second control cam means for adjusting the position of the tamping means relative to the associated cell floor comprising stationary cam means comprising a step for allowing displacement of said tamping means at least by the amount of the height of a cigarette layer at load positions and movable cam means for temporarily positioning the tamping means against a cigarette layer during rotation of said cell and releasing said tamping means at the load positions.

12. Apparatus according to claim 11 wherein the tamping means further comprise two coaxial rollers of which one can be brought into engagement with the stationary cam means and the other with the movable cam means.

13. Apparatus according to claim 11 further comprising cam-controlled crank means for controlling the movement of the movable cam means.

14. Apparatus according to claim 11 further comprising a guide journal disposed laterally relative to the cell and said tamping means is mounted to at least one guide journal.

15. Apparatus according to claim 11 further comprising a rocker having two arms and wherein each cell is articulated rotatably on the group-forming turret means via said rocker, the first control cam means further comprising two cam disks of which one is in engagement with one rocker arm and the other with the other rocker arm.

16. Apparatus according to claim 11 further comprising a spring which biases the tamping means into a position closing off a particular cell relative to the outside.

17. Apparatus according to claim 11 wherein the guide journal further has a stop for limiting the maximum displacement of the tamping means.

18. Apparatus according to claim 11 wherein the tamping means planar surface is positionable outwards in relation to the radially inner cell floor.

19. Apparatus for forming cigarette groups comprising a plurality of layers of cigarettes for a pack, said apparatus comprising:

turret means for forming cigarette groups comprising a turret rotatable about a first axis;

cell means comprising a plurality of cells each having a floor for receiving cigarette groups, said cells being pivotally mounted to said turret means for rotation coaxially of said first axis;

funnel means comprising means defining a plurality of parallel exit orifices;

first control cam means engageable with the cell means for aligning the cells with the exit orifices at load positions;

transfer means for axially transferring a cigarette layer from an exit orifice to a cell;

tamping means for tamping a cigarette layer in each cell, said tamping means comprising a tamping member having a planar portion generally parallel to a cell floor, said member being mounted to a pair of guide journals comprising stops for limiting the maximum displacement of the tamping member; and second control cam means for adjusting the position of the tamping means relative to an associated cell floor comprising stationary cam means comprising a recessed step for allowing displacement of said tamping means at least by the amount of the height of a cigarette layer at load positions and movable cam means for temporarily positioning the tamping means against a cigarette layer during rotation of said cell and releasing said tamping means at the load positions.

20. Apparatus according to claim 19 further comprising a spring which biases the tamping means into a position closing off a particular cell.

* * * * *